US005333036A

United States Patent [19]

Koga

[11] Patent Number: 5,333,036

[45] Date of Patent: Jul. 26, 1994

[54] MOUNTING MECHANISM OF PROCESS CARTRIDGE FOR IMAGE FORMING APPARATUS

[75] Inventor: Yuji Koga, Nagoya, Japan

[73] Assignee: Brother Kogyo Kabushiki Kaisha, Nagoya, Japan

[21] Appl. No.: 63,978

[22] Filed: May 20, 1993

[30] Foreign Application Priority Data

Jul. 28, 1992 [JP] Japan ..... 4-058640

[51] Int. Cl.[5] ..... G03G 15/00

[52] U.S. Cl. ..... 355/200; 355/210

[58] Field of Search ..... 355/200, 210, 211; 346/160

[56] References Cited

U.S. PATENT DOCUMENTS 4,634,264 1/1987 Takahashi ..... 355/200

4,873,548 10/1989 Kobayashi et al. ..... 355/200

5,095,335 3/1992 Watanabe et al. ..... 355/210

*Primary Examiner*—Joan H. Pendegrass

*Attorney, Agent, or Firm*—Oliff & Berridge

[57] ABSTRACT

An electrophotographic apparatus comprises a cartridge holder for holding a process cartridge, an member for outwardly biasing the process cartridge, and a guide member for guiding the process cartridge into a specified position during the process of closing the upper unit. The operation of removing the process cartridge is made easier by biasing of the process cartridge by means of the urging member toward the position of the opening of the process cartridge. Mounting the process cartridge is also made securely by guiding the process cartridge into a specified position by means of the guide member.

21 Claims, 10 Drawing Sheets

MOUNTING MECHANISM OF PROCESS CARTRIDGE FOR IMAGE FORMING APPARATUS

BACKGROUND OF THE INVENTION

1. Field of the Invention

The present invention relates to a mounting mechanism of a process cartridge for an image forming apparatus comprising image forming process elements including an electrostatic member, a developing device, a corona charger, and a cleaning device.

2. Description of Related Art

An image forming apparatus comprising electrophotographic process elements such as an electrophotographic photosensitive member, a developing device, a corona charger, and a cleaning device has been known, as described in U.S. Pat. No. 4,878,548, in which the electrophotographic process elements are made into an integral process cartridge capable of being mounted on or removed from the main unit of the apparatus. The construction and operation of such an electrophotographic apparatus are explained in reference to FIGS. 6 through 9 of this application.

The electrophotographic apparatus comprises an automatic paper sheet feeder 4 and a manual paper sheet feeder 5. A paper sheet 6 is fed by either one of the paper sheet feeders 4 and 5 and guided to a pair of resist rollers 10 and 11 by paper sheet guides 7, 8, and 9 disposed downstream of the paper sheet feeders 4 and 5.

If a paper sheet detection sensor 12 disposed upstream of the pair of resist rollers 10 and 11 detects the passage of a paper sheet 6 and a predetermined period of time elapses from the time of detection, the pair of resist rollers 10 and 11 start to rotate. The paper sheet 6 with its skew feed corrected by the resist rollers 10 and 11 is fed downstream while being sandwiched between the rollers 10 and 11 according to the rotation of the rollers 10 and 11.

Paper sheet guides 13*a* and 13*b* are disposed in a confronting relationship with each other to form a paper sheet passage downstream of the resist rollers 10 and 11. The paper sheet 6 after being fed out of the resist rollers 10 and 11 is fed to an image forming section 50 while guided by the paper sheet guides 13*a* and 13*b*.

The image forming section 50 comprises an electrophotographic photosensitive member 15 having a drum base with electric conductivity and a photoconductive layer, a corona charger 20 for uniformly charging the electrophotographic photosensitive member 15, an exposure device 26 for projecting an optical image onto the electrophotographic photosensitive member 15, a developing device 21 holding toner therein for developing an electrostatic latent image formed by the projection, a transfer section 14 for transferring the developed, visualized toner image to the paper sheet 6, and a discharging section 16 for electrically discharging the paper sheet 6 after the transfer process and separating the paper sheet 6 from the electrophotographic photosensitive member 15.

The photosensitive member 15 is journaled to be rotatable in the direction of the arrow A. Around the photosensitive member 15, arranged in its rotating direction, are the corona charger 20, the exposure device 26, the developing device 21, the transfer section 14, the discharging section 16, and a cleaning device 22. The photosensitive member 15, the corona charger 20, the developing device 21, and the cleaning device 22 are constructed as an integral process unit 51.

After forming the image on the paper sheet 6 in the image forming section 50, the paper sheet 6 is guided over a guiding section 17 and transferred further downstream to a fixing device 18. After the image is fixed by heat and pressure of the fixing device 18 onto the paper sheet 6, the paper sheet 6 is sent out into a discharged paper sheet tray 27 by a pair of paper sheet discharge rollers 28 and 29.

The electrophotographic apparatus of the construction described above requires replacement of components of the image forming section 50 in the following situations. The developing device 21 has to be replaced when the toner is exhausted. The corona charger 20 requires replacement when the surfaces of charging wires become dirty with toner and dust. The cleaning device 22 must be replaced when toner deposits form thereon. The photosensitive member 15 requires replacement when its surface characteristic deteriorates.

The developing device 21, the corona charger 20 and the cleaning device 22 must be disposed within specified distances relative to the photosensitive member 15. Such distances, however, are changed if the developing device 21, the corona charger 20, and the cleaning device 22 are replaced individually. As a result, there has been a problem of lower image quality after replacement. Another problem associated with such a manner of replacement has been that if the surface of the photosensitive member 15 is touched by hand and its characteristic is changed or the surface is damaged, the touched or damaged part of the photosensitive member 15 becomes incapable of forming the image.

In view of the above mentioned problems, a manner of the maintenance of the apparatus has been proposed and put to practical use in which the components of the image forming section 50 are made into an integral unit or the components having similar service lives are arranged into several blocks. Thus, the integral unit or the set of the several blocks is handled as a process cartridge 51 so that the maintenance of the apparatus is carried out by replacing the process cartridge 51.

The construction of such a process cartridge 51 is explained with reference to FIG. 7. Electrophotographic process elements include a replenishment toner holding section 52, the developing device 21, the photosensitive member 15, the corona charger 20, the cleaning device 22, and a waste toner holding section 53 connected by an outer frame 54 to construct the integral process cartridge 51. As a result, such electrophotographic process elements can be replaced as a whole. The process cartridge 51 is electrically connected on one side in its longitudinal direction by a high tension connector 55 provided on the main unit side of the electrophotographic apparatus.

As seen from FIG. 8, the main unit of the electrophotographic apparatus is divided into an upper unit 3 and a lower unit 1 on both sides of the paper sheet transfer passage. The electrophotographic apparatus is constructed as an apparatus of a shell type in which the upper unit 3 can be swung to open and close about a single shaft 2 on the lower unit 1. Therefore, in the case when the paper sheet 6 is jammed, the jammed paper sheet can be easily removed by opening the upper unit 3. As shown also in FIG. 9, the replacement of the process cartridge 51 attached to the upper unit 3 is made relatively easily.

However, when the process cartridge 51 is to be removed from or mounted on the electrophotographic apparatus, an operator's hand has to access the inside of the apparatus where the high temperature fixing device 18, the transfer device 14, the developing device 21, and the high voltage discharging unit 16 are located. This poses a danger of burns and electric shocks to the operator.

Furthermore, when the process cartridge 51 is to be mounted on the electrophotographic apparatus, the mounting has to be very precise so that the connection to the high tension connector 55 is secure. This involves the possibilities of an inability to make the electric connection or further damage to the high tension connector 55 and/or connecting parts of the process cartridge 51 depending on the positional accuracy of mounting the process cartridge 51.

A further possible problem is that if the process cartridge 51 is not mounted in the specified position, the electrophotographic photosensitive member 15 hits the resist rollers, and the member 15 is damaged which leads to the lowering in quality of the image.

The process cartridge 51 is interlocked with the opening and closing movements of the upper unit 3 centered on the shaft 2. Therefore, the process cartridge also moves along an arc centered on the shaft 2 when the upper unit 3 is opened or closed. As a result, because a connector 56 on the process cartridge 51 side is connected with the high tension connector 55, as shown in FIG. 7, a cover 58 arranged around a coil 57 is slanted toward the rotation center of the upper unit 3.

SUMMARY OF THE INVENTION

An object of the present invention is to provide a mounting mechanism of a process cartridge for an image forming apparatus, wherein the process cartridge can be safely removed from and mounted on the apparatus and the process cartridge can be very easily mounted at a specified position.

In order to achieve the above and other objects, the image forming apparatus of the present invention comprises a process cartridge detachably installed in the image forming apparatus having at least one of a photosensitive drum, a developing device, a charging device and a cleaning device; cartridge receiving means having an opening for receiving said process cartridge and holding said process cartridge therein; spring means for biasing said cartridge in a direction of the opening; and a guide for guiding said process cartridge from the opening to a predetermined position in said cartridge receiving means.

In operation of the image forming apparatus of the above structure, when the process cartridge is detachably received in the opening of the cartridge receiving means, the spring means biases the cartridge in a direction of the opening. After the process cartridge is received in the opening and the process cartridge is held in the cartridge receiving means, the guide guides the process cartridge from the opening to a predetermined position in said cartridge receiving means.

According to the present invention as described above, because the cartridge receiving means and the spring means are provided, the process cartridge is biased toward the opening of the cartridge receiving means.

As a result, removal and mounting of the process cartridge can be performed safely and easily without the operator putting his or her hand into the apparatus. Because the guide is provided for guiding the process cartridge to the predetermined position in the cartridge receiving means, the process cartridge is mounted accurately along with the closing action of the image forming apparatus by simply inserting the process cartridge into the cartridge receiving means.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

The first embodiment of the present invention is described below in detail in reference to FIGS. 1 through 5. Components similar to those of the conventional apparatus are denoted by same symbols and detailed explanations thereof are omitted.

Figure 1:
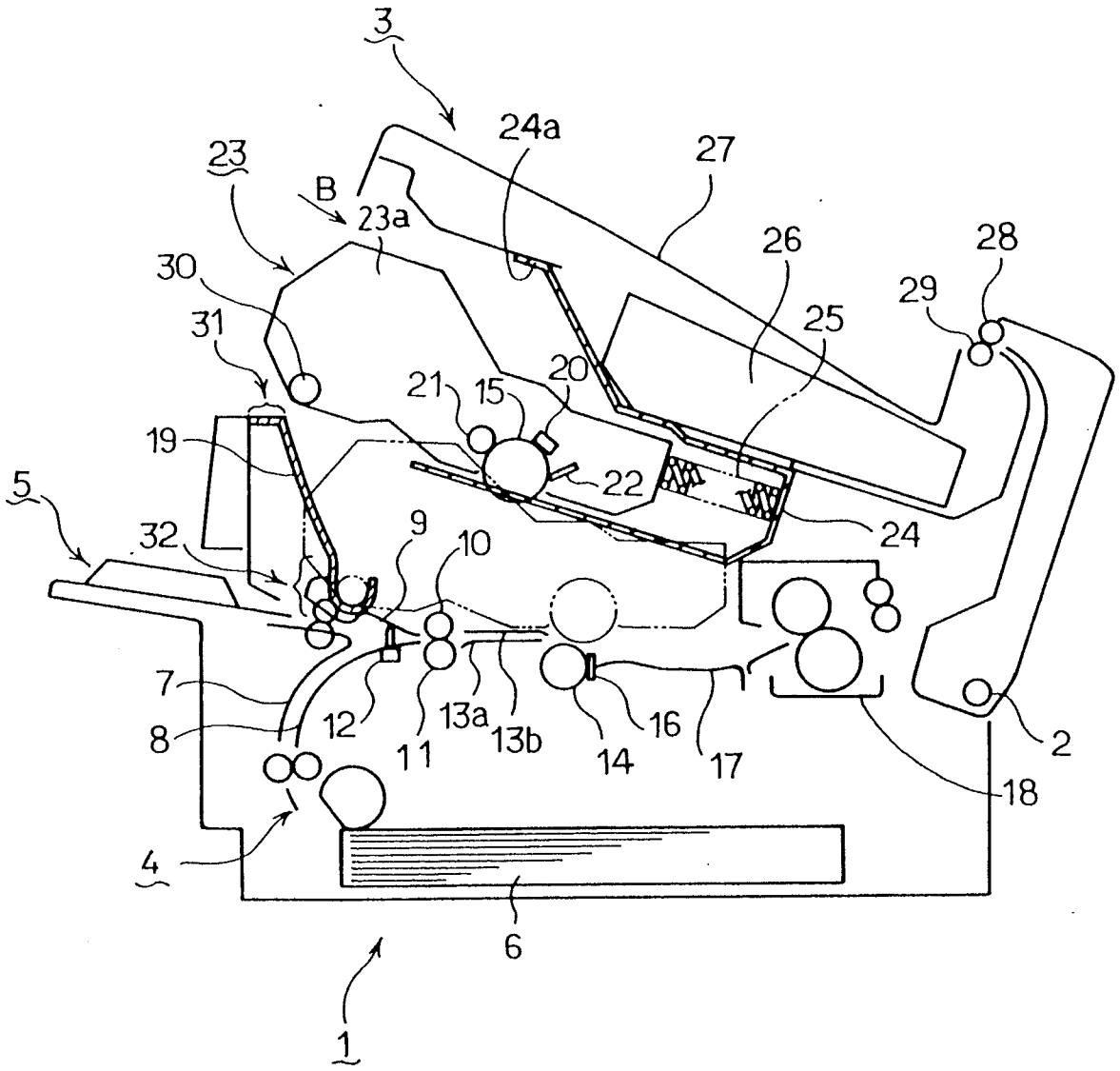
FIG. 1 is a schematic sectional side view of the first embodiment of the electrophotographic apparatus according to the present invention.

FIG. 1 shows the opened condition of the main unit of the apparatus. The dash-and-double-dotted line shows the closed condition of the process cartridge. The main unit of the electrophotographic apparatus is constructed as a shell type arrangement divided into two, or upper and lower, units on both sides of the paper sheet transfer passage. The upper unit 3 is capable of being opened and closed by the rotary movement about the single shaft 2.

The lower unit 1 comprises the automatic paper sheet feeder 4, the manual paper sheet feeder 5, paper sheet guides 7, 8, and 9, a pair of resist rollers 10 and 11, the paper sheet detection sensor 12, the paper sheet guides 13*a* and 13*b*, the transfer section 14, the discharging section 16, the transfer guide section 17, and the fixing device 18. Guide members 19 by which the present invention is characterized are attached in the front area of the apparatus, on the outer frame of the electrophotographic apparatus.

The upper unit 3 comprises the process cartridge 23 as an integral unit, incorporating a plurality of electrophotographic process elements such as the electrophotographic photosensitive member 15, the corona charger 20, the developing device 21 and the cleaning device 22, the exposure device 26, a pair of paper sheet discharge rollers 28 and 29 and the discharged paper sheet tray 27. The upper unit 3 further comprises a holding section, or a cartridge holder 24 (hereinafter called the holder) for holding a process cartridge 23, which is the characteristic feature of the present invention, and an urging member 25 for biasing the process cartridge 23.

Components other than the guide members 19, the holder 24, and urging member 25 are the same as those of the conventional apparatus, and their detailed explanations are omitted here.

Figure 3:
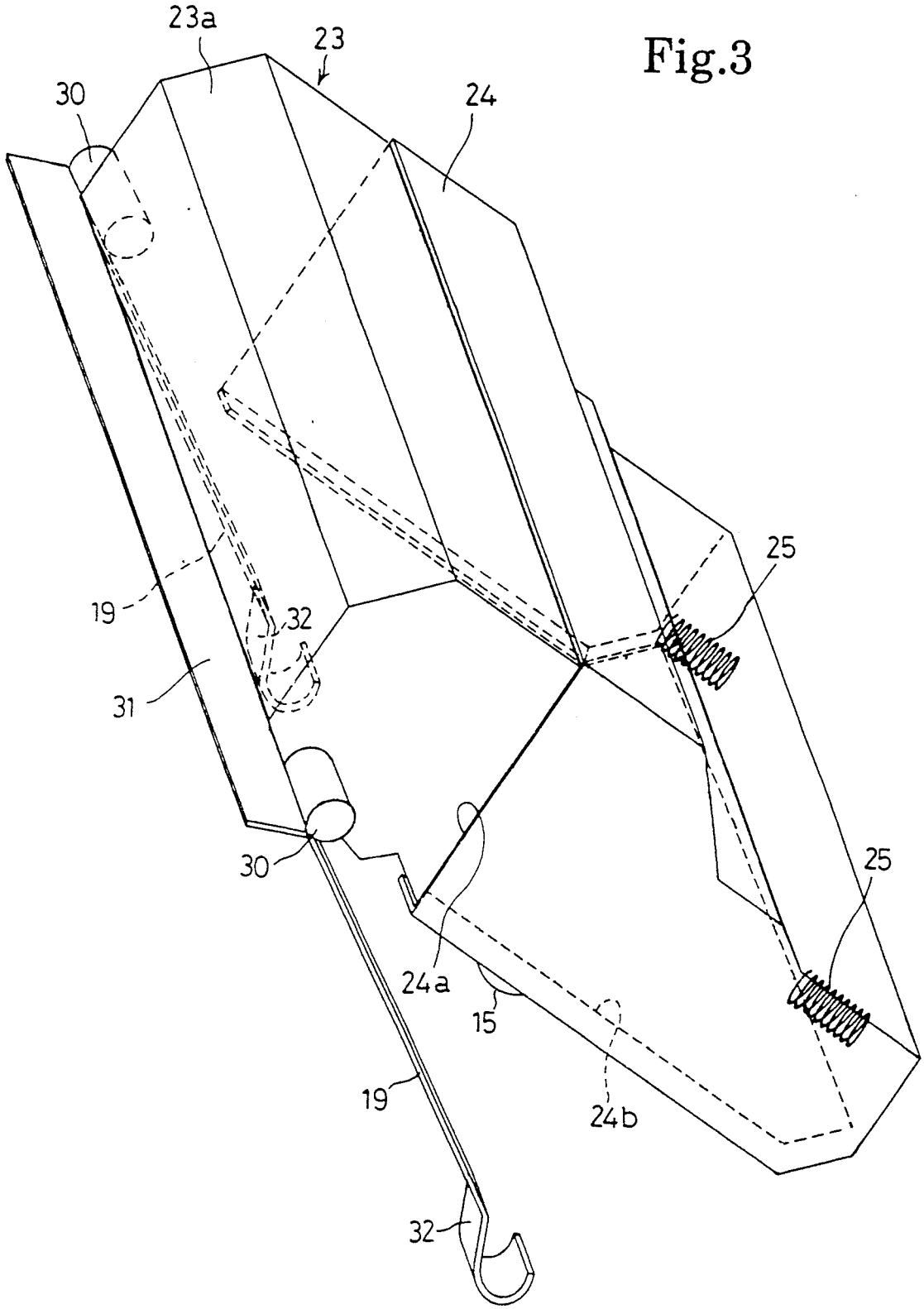
FIG. 3 is a perspective view of the electrophotographic apparatus according to the first embodiment.

The arrangement of the holder 24, urging member 25, and guide members 19 is described in reference to FIGS. 1 and 3. The holder 24 is shaped to enclose the process cartridge 23 from above and has an opening 24*a* large enough for inserting the process cartridge 23 in the direction of the arrow B as shown in FIG. 1.

The holder 24 is also provided, as shown in FIG. 3, on its bottom side with an opening 24*b* wider than the paper sheet width. Part of the electrophotographic photosensitive member 15 is exposed out of the opening 24*b* so that an electrostatic latent image on the photosensitive member 15 can be transferred to the paper sheet 6. The holder 24 is preferably mold formed with a 2.5 mm to 3.5 mm thick thermoplastic resin so as to be capable of holding the process cartridge 23.

The urging member 25 is arranged on the inside back surface in the inserting direction of the process cartridge 23 in the holder 24 to urge the process cartridge 23 toward the opening 24*a*. The urging means 25 is constructed with a compression spring made of a piano wire (SWP according to the JIS code) or steel wire (SWA according to the JIS code). The direction and magnitude of the urging force are set to urge and push the process cartridge 23 in the direction opposite to the inserting direction B. Any urging member which sufficiently biases the process cartridge outward may be used.

The guide member 19 is formed with molded thermoplastic resin such as polyacetals to provide smooth slope surfaces. A guide member 19 is arranged on both end sides of the lower unit 1 in the longitudinal direction of the electrophotographic photosensitive member 15. Each guide member 19 is an elongate member having a top horizontal portion 31, a sloping central body portion and a bottom hook-shaped portion 32.

Cylindrical contact members 30 are provided on the lower end portions of the process cartridge 23 to come into contact with the guide members 19. In the present embodiment, the contact members 30 are formed as part of an outer frame 54 of the process cartridge 23. The contact members 30 are arranged to project outwardly beyond the outer frame 54. These projecting contact members 30 are movable along the guide members 19. The hook-shaped portions 32 are formed at the end portions of the guide members to receive the contact members 30 and fix the process cartridge 23 in the predetermined precise position.

Furthermore, as shown in FIG. 3, the horizontal portion 31 is provided on a side of the lower unit 1 on the opposite side of the single shaft 2. The end portions of the guide members 19 which are opposite to the hook-shaped portions extend from the end portions of the horizontal portion 31.

The movement of the process cartridge of the construction described above is described below with reference to FIGS. 1 and 2.

As shown in FIG. 1, when the upper unit 3 is swung and opened, because the process cartridge 23 is supported by the holder 24 and biased by the urging member 25 arranged in the holder 24 toward the opening 24*a* of the upper unit 3, at least part of the process cartridge 23, or the projecting portion 23*a* projects out of the opening 24*a*.

The urging member 25 is set to be capable of supporting the weight of the process cartridge 23. The projecting portion 23*a* of the process cartridge 23 is made in a shape to be gripped by hand so that the removal and mounting of the process cartridge 23 can be easily and safely performed by gripping the projecting portion 23*a*. This makes it possible to replace the process cartridge 23 safely and easily without putting a hand into the main unit of the electrophotographic apparatus.

Figure 2:
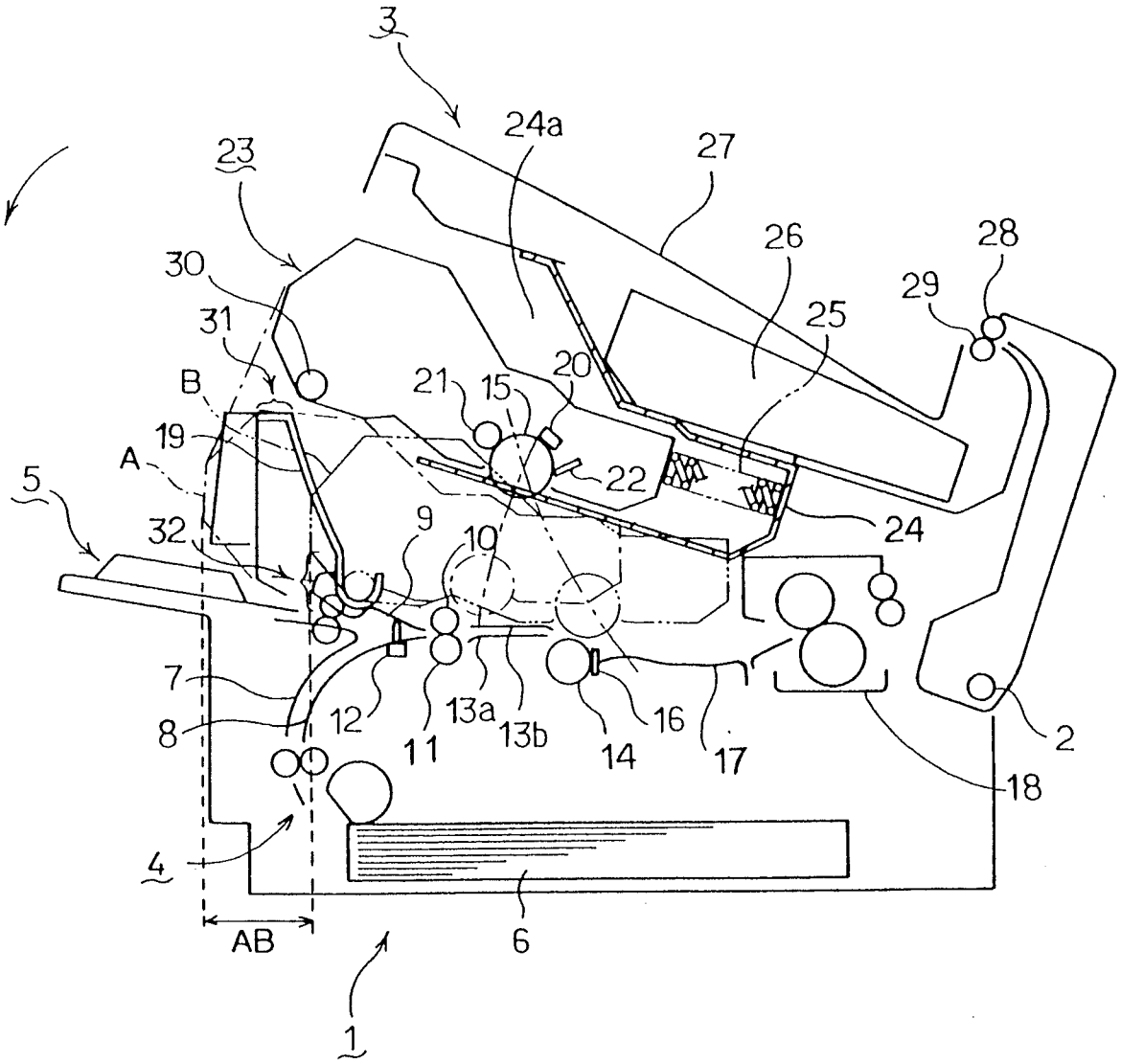
FIG. 2 is a schematic side view for explaining the movement, along the guide section, of the process cartridge in the electrophotographic apparatus according to the first embodiment.

The function of the guide members 19 at the time of closing the upper unit 3 is described in reference to FIGS. 2 and 3. If it is assumed that there are no guide members 19, the process cartridge 23 as shown in FIG. 2 with solid lines, in the process of the upper unit 3 being closed, is biased by the urging member 25 toward the opening 24*a* and follows an arc centered on the shaft 2 which is the center of rotation of the upper unit 3.

The position A of the process cartridge 23 in this case as shown with the dash-and-dotted lines is apart from the position B of the process cartridge 23 where it should be for correct functioning as shown with dash-and-double-dotted lines by a distance of AB as shown in FIG. 2. As a result, since the electrophotographic photosensitive member 15 is positioned above the resist roller 10, the image cannot be reproduced and the upper unit 3 cannot be closed.

On the other hand when there are guide members 19, as in the case of the present invention, the contact members 30 of the process cartridge 23 are pressed, during the closing process of the upper unit 3, in a downward direction and to the right as seen in FIG. 2 from the contact members 30 sliding against the sloped surfaces of the guide members 19.

Along with this movement, the process cartridge 23 itself moves to the right as seen in FIG. 2 along the sloped surface up to the position B where it is originally intended to be. In other words, the guide members 19 function to cause the process cartridge 23 to shift by the distance AB shown in FIG. 2 along with the closing movement of the upper unit 3. Therefore, the process cartridge 23 can be moved to the specified position when the upper unit is brought to the closed condition irrespective of the position in which the process cartridge is inserted. Therefore, the process cartridge 23 can be mounted securely even if the operator does not exercise special caution.

The guide members 19 are provided at their top ends with a horizontal portion 31 as shown in FIGS. 1 and 2 for preventing the process cartridge 23 from being incorrectly mounted by the operator. It is so constructed that if the process cartridge 23 is not mounted to the specified position and an attempt is made to close the upper unit 3, the contact members 30 of the process cartridge 23 strike against the horizontal portion 31 and the upper unit 3 cannot be closed.

Figure 4:
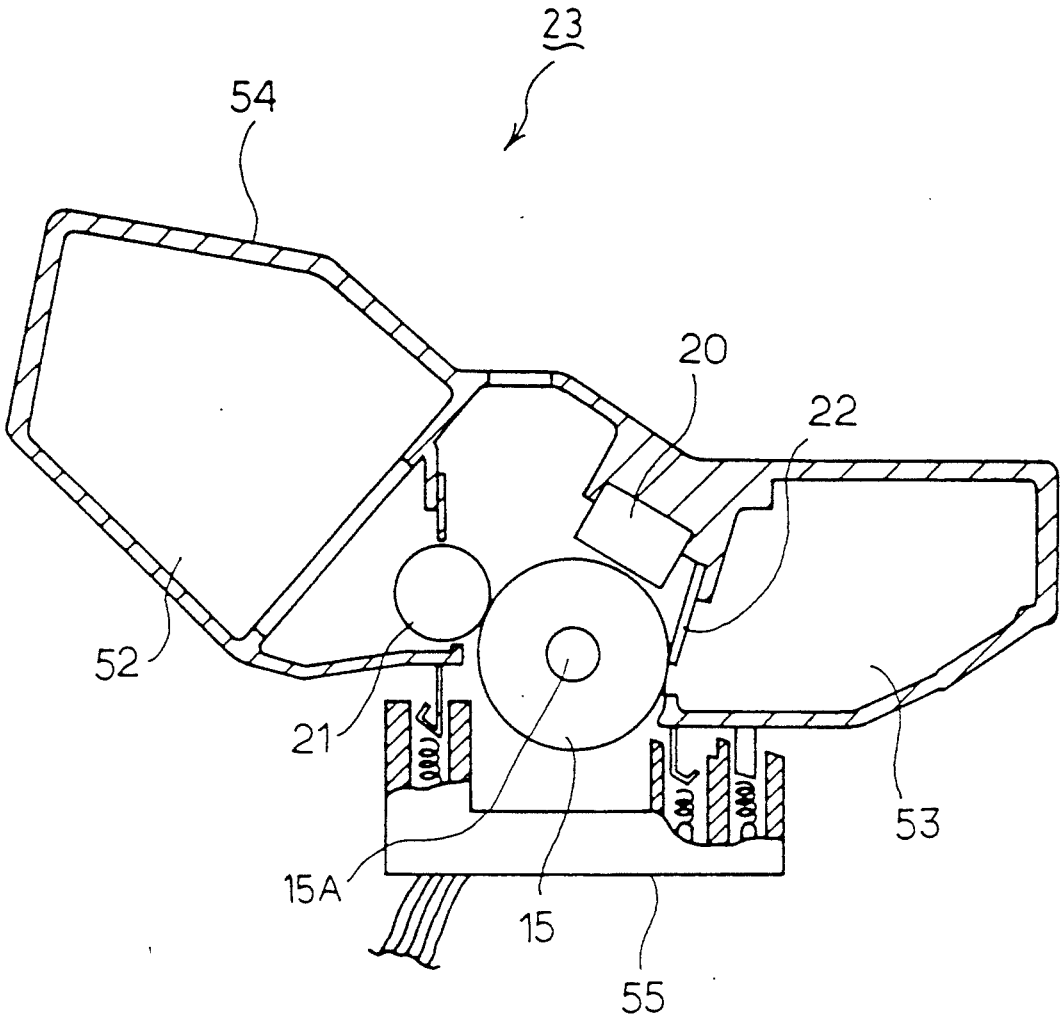
FIG. 4 is a schematic sectional side view showing the process cartridge being connected to the piezoelectric connector.

Moreover, as shown in FIG. 1, the bottom end portions of the guide members 19, or vertical portions 32 are made generally perpendicular to the horizonal. Therefore, when the contact members 30 are guided by the vertical portions 32, the process cartridge 23 moves in a vertical direction. As a result, the process cartridge 23 is connected to the high tension connector 55 as shown in FIG. 4 from the vertical direction. Therefore, unlike the conventional apparatus, the connector itself is not required to function as a guide and to have a wide opening. As a result, the connector is prevented from being damaged. Furthermore, the design of the connector becomes simpler, and its manufacture is made easier.

Figure 5:
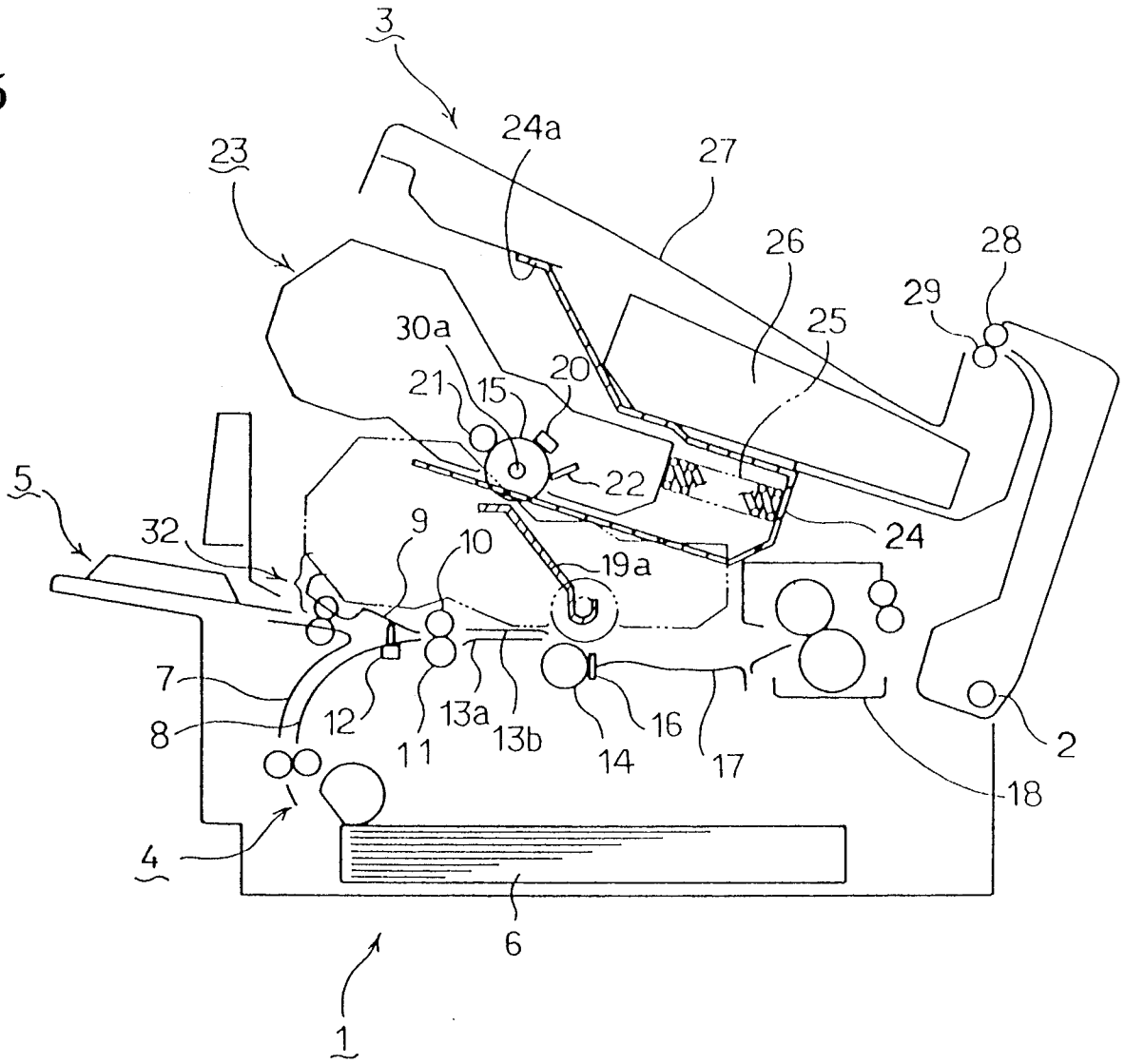
FIG. 5 is a schematic sectional side view of the second embodiment of the electrophotographic apparatus according to the present invention.
Figure 5A:
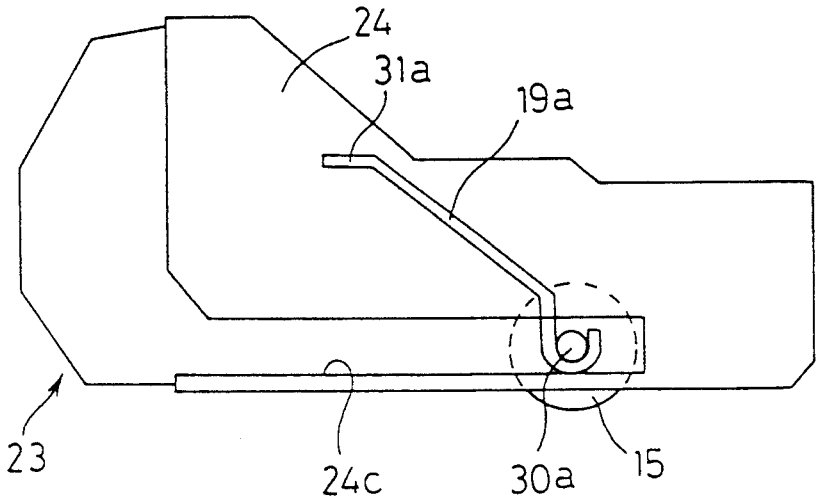
FIG. 5A is a side view of the process cartridge received in the holder according to the second embodiment.
Figure 6:
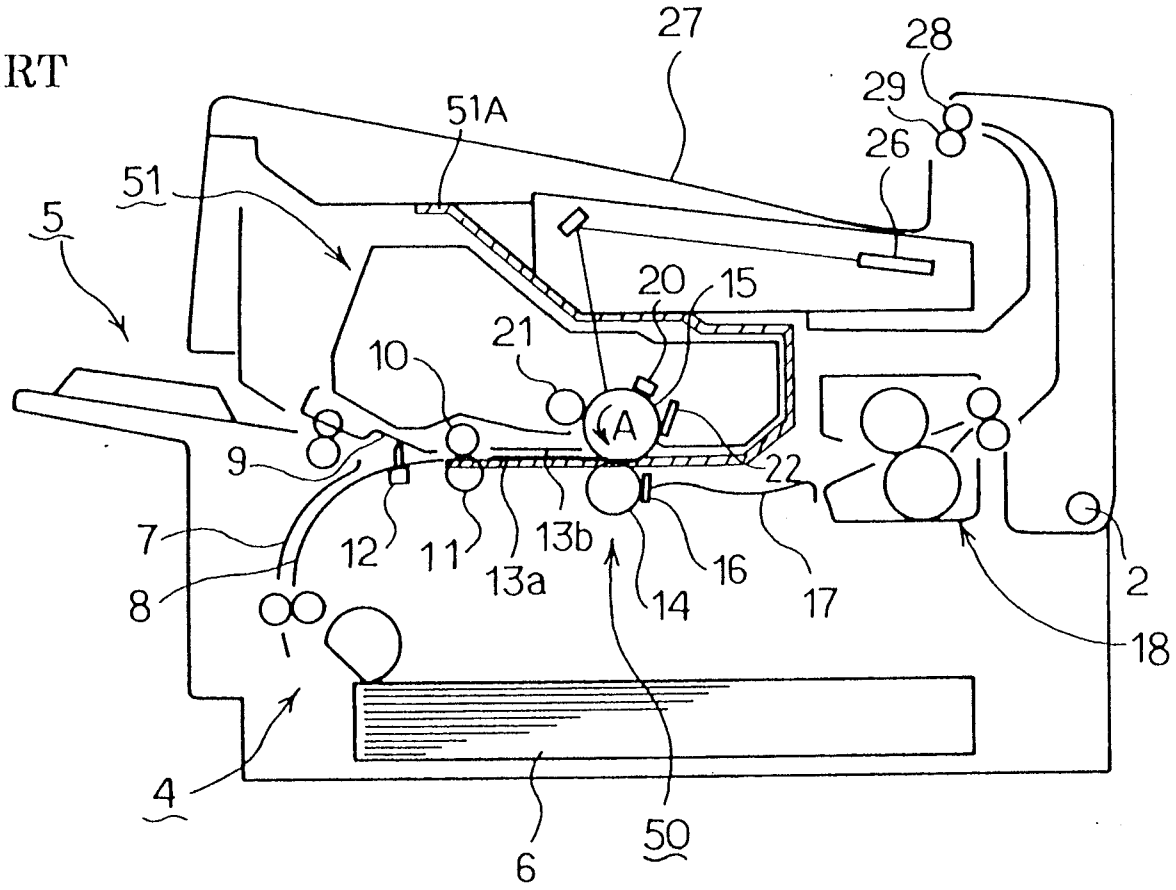
Fig.6 RELATED ART
FIG. 6 is a schematic sectional side view of a conventional electrophotographic apparatus.
Figure 7:
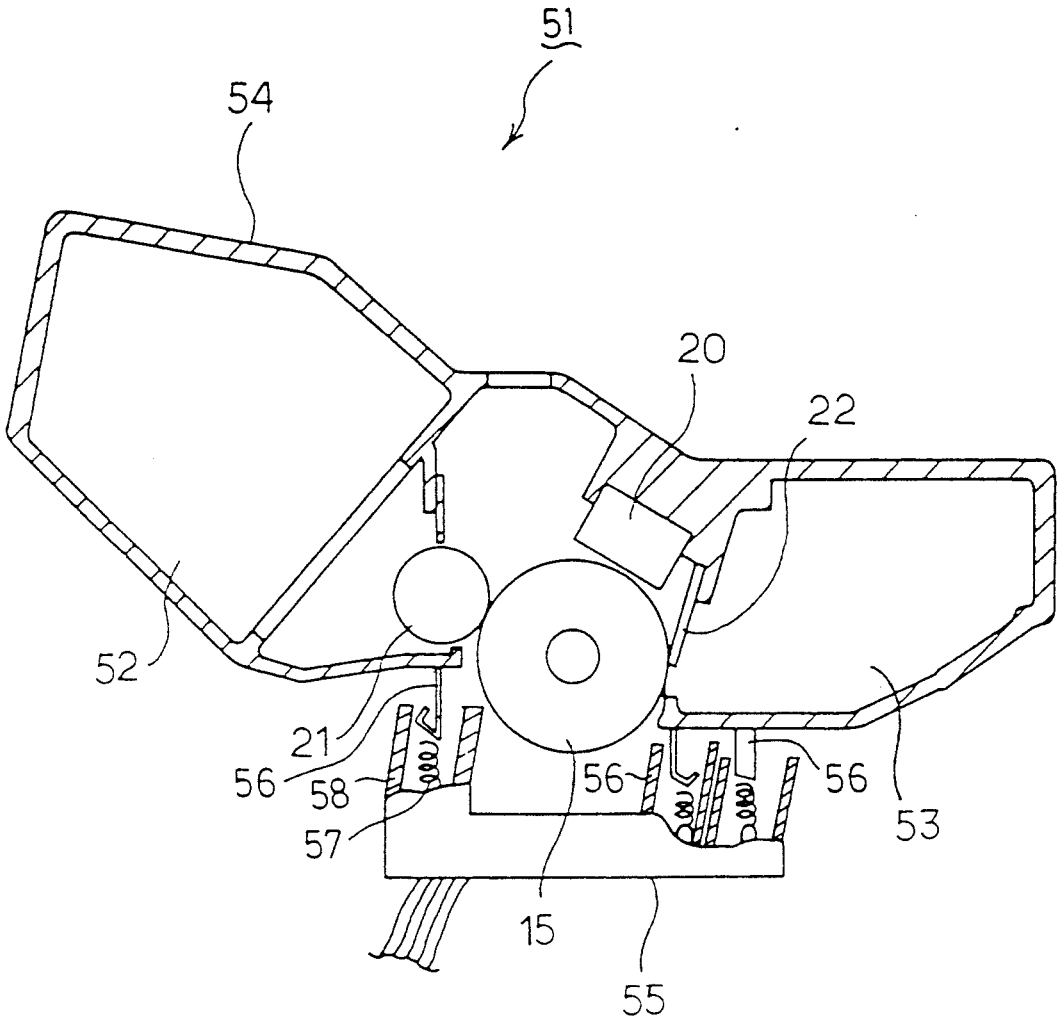
Fig.7 RELATED ART
FIG. 7 is a schematic sectional side view showing the process cartridge being connected to the piezoelectric connector in the conventional electrophotographic apparatus.
Figure 8:
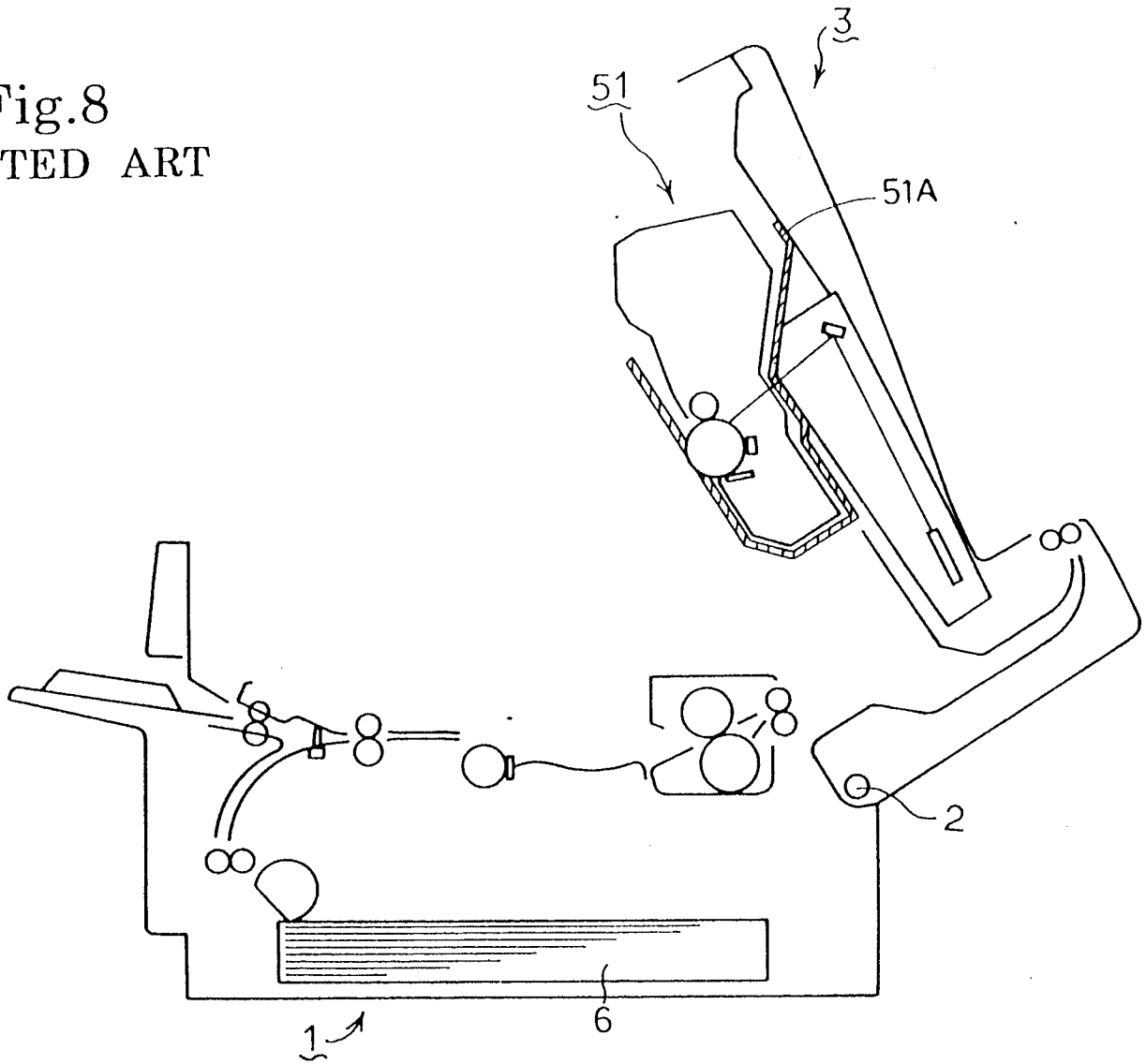
Fig.8 RELATED ART
FIG. 8 is a schematic sectional side view for explaining the upper unit of the conventional electrophotographic apparatus being opened for handling a paper sheet jamming.
Figure 9:
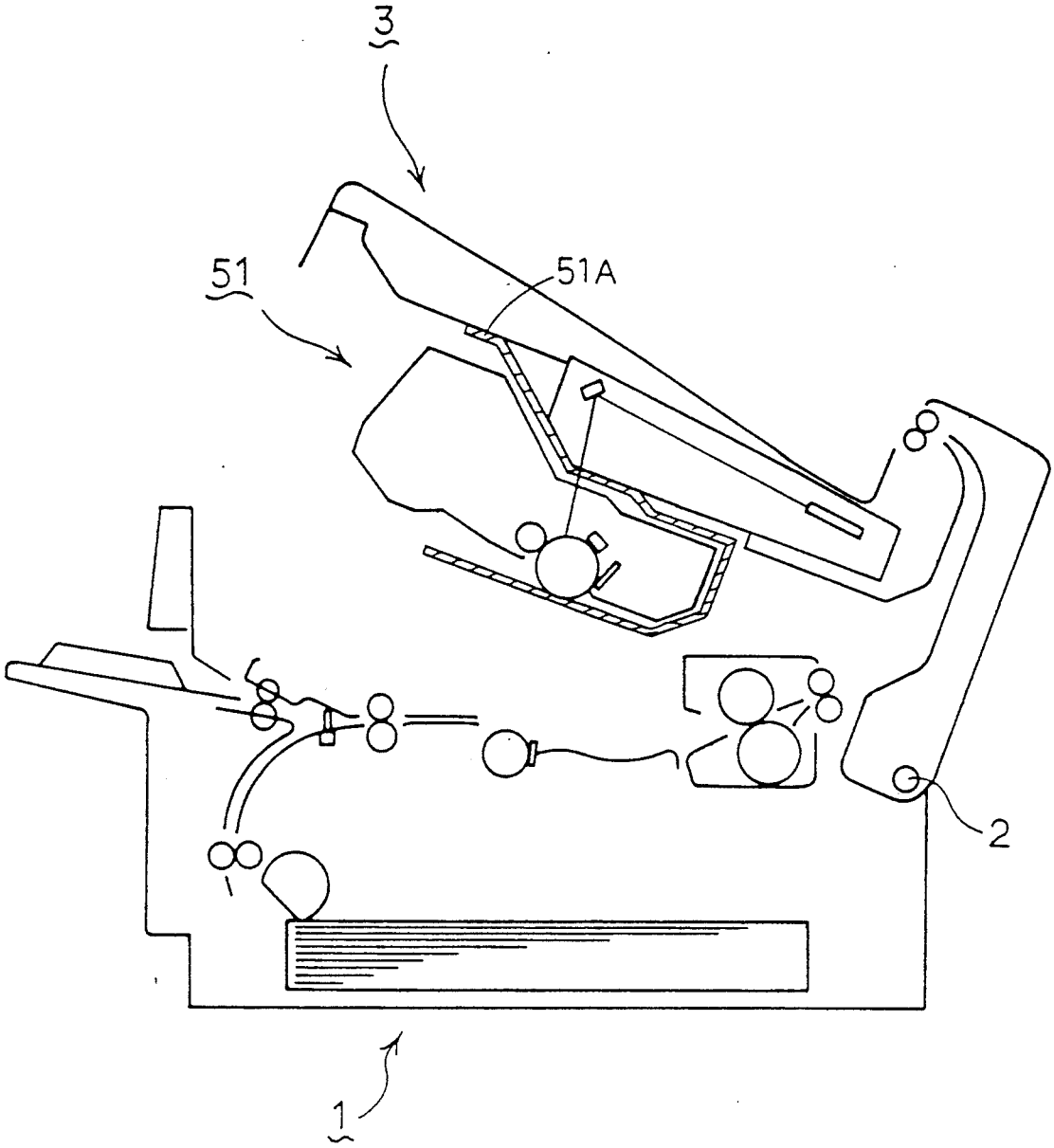
Fig.9 RELATED ART
FIG. 9 is a schematic sectional side view for explaining the upper unit of the conventional electrophotographic apparatus being opened for replacing the process cartridge.

Now a second embodiment is described in reference to FIG. 5 and FIG. 5A.

The second embodiment is of the same construction as the first embodiment except for contact members 30*a*, guide members 19*a*, horizontal portion 31*a* and side openings 24*c*. Therefore, detailed description of the same construction as the first embodiment is omitted.

In the second embodiment, the contact members 30*a* are located in the center of the sides of the photosensitive member 15. Namely, the contact members 30*a* are located on the supporting shaft of the photosensitive member 15. The guide members 19*a* are attached to the outer frame of the main unit of the electrophotographic apparatus so that the photosensitive member 15 is positioned in a specified position confronting the transfer section 14. As shown in FIG. 5A, side openings 24*c* are provided on the sides of the holder 24 such that the contact members 30*a* can move along the guide members 19*a* to the specified position.

The guide members 19*a* are provided at their top end with horizontal portions 31*a* as shown in FIGS. 5 and 5*a*. In the second embodiment, the horizontal portions 31*a* have almost the same widths as the guide members 19*a*. The effect of the horizontal portions 31*a* is the same as the horizontal portion 31 in the first embodiment in that the upper unit 3 is prevented from closing if the process cartridge 23 is incorrectly mounted by interfering with contact members 30*a*.

Since the contact members 30*a* are provided on the sides of the photosensitive member 15, the positioning of the process cartridge 23 is made based on the positioning of the photosensitive member 15. As a result, the positioning of the process cartridge 23 with respect to the lower unit 1 is made more accurately. Thus, accurate alignment between the transferred paper sheet 6 and the latent image on the photosensitive member 15 in the lower unit 1 can be made easily.

The present invention is not limited to the embodiments described above and can be modified without departing from the scope of the invention encompassed by the appended claims.

What is claimed is:

1. A mounting mechanism for an image forming apparatus having a lower unit and an upper unit hinged to the lower unit, the upper unit and the lower unit defining a sheet transfer path, the mounting mechanism comprising:

a holder adapted to be disposed in the upper unit, said holder including a body shaped to receive a removable cartridge, said body having an open front portion shaped to receive the cartridge, a back portion, side portions extending from said front to said back and a bottom portion with an opening shaped larger than an image recording sheet;

an urging member disposed in said holder and coupled to said back portion facing said front portion adapted to urge the cartridge out of said body; and at least one guide member adapted to be disposed in the lower unit including a sloped surface adapted to guide the cartridge into the image forming apparatus and a receiving portion adapted to hold the cartridge in operating position within the image forming apparatus.

2. The mounting mechanism of claim 1, wherein said body includes inwardly directed flanges in said bottom defining said opening.

3. The mounting mechanism of claim 1, wherein said body has elongate slots in said sides extending from said open front toward said back.

4. The mounting mechanism of claim 1, wherein said urging member is a compression spring.

5. The mounting mechanism of claim 1, wherein said at least one guide member is a pair of guide members, each having a top generally horizontal portion, and said sloped surface is a central section sloping from said top portion to said receiving portion, and said receiving portion is a hook-shaped portion having generally vertical walls.

6. The mounting mechanism of claim 5, wherein said top generally horizontal portion of each said guide member connects with each other forming a generally horizontal shelf.

7. A removable cartridge for use in an image forming apparatus having a lower unit and an upper unit hinged to the lower unit, comprising:

a body adapted for insertion into the upper unit, said body including a front surface, an upper surface configured to mate with the upper unit and a lower surface configured to mate with the lower unit, said body containing image forming elements and having a front gripping formation and at least one contact member extending outwardly from said body, said at least one contact member adapted for contact with the lower unit, wherein said gripping formation is formed by said front surface projecting from said upper surface and said lower surface with angled walls.

8. The removable cartridge of claim 7, wherein said image forming elements are electrophotographic elements.

9. The removable cartridge of claim 7, wherein said at least one contact member includes a pair of cylinders extending outwardly from sides of said body.

10. The removable cartridge of claim 7, wherein said body houses an photosensitive member and a shaft, said photosensitive member being rotatably disposed on said shaft, and wherein said at least one contact member comprises a formation extending from each end of said shaft.

11. The removable cartridge of claim 7, wherein said image forming elements include a rotatable photosensitive member, a developing device, a corona charger and a cleaning device, and said body has a high tension connector thereon.

12. An image forming apparatus comprising:

a lower unit;

an upper unit hinged to said lower unit, said upper unit and said lower unit defining a sheet transfer path;

a cartridge removably disposed in said upper unit;

a holder disposed in said upper unit receiving said cartridge;

an urging member coupled to said holder and disposed between said holder and said cartridge thereby urging said cartridge out of said holder in a detachable direction of said cartridge; and a pair of guide members disposed in said lower unit, each guide member including a sloped surface guiding said cartridge into said holder and a receiving portion holding said cartridge in an operating position within the image forming apparatus.

13. The image forming apparatus of claim 12, wherein said cartridge comprises a body shaped to correspond to said holder, a front gripping formation and a pair of contact members extending outwardly from said body, said contact members contacting said guide members.

14. The image forming apparatus of claim 13, wherein said contact members include a pair of cylinders extending outwardly from said body.

15. The image forming apparatus of claim 12, wherein said cartridge includes a rotatable photosensitive member carried on a shaft, a developing device, a corona charger and a cleaning device.

16. The image forming apparatus of claim 15, wherein contact members are disposed on each end of said shaft.

17. The image forming apparatus of claim 12, wherein said holder comprises a body having an open front portion shaped to receive said cartridge, a back portion, side portions extending from said front to said back and a bottom portion with an opening shaped larger than an image recording sheet.

18. The image forming apparatus of claim 12, wherein said sides of said holder have an elongated slot formed therein receiving and guiding said cartridge.

19. The image forming apparatus of claim 12, wherein said at least one guide member is a pair of guide members, each having a top generally horizontal portion, and said sloped surface is a central section sloping from said top portion to said receiving portion, and said receiving portion is a hook-shaped portion having generally vertical walls.

20. The image forming apparatus of claim 19, wherein said a top generally horizontal portion of each said guide member connects with each other forming a generally horizontal shelf.

21. The image forming apparatus of claim 17, wherein said urging member is coupled to said back portion facing said front portion adapted to urge said cartridge out of said body.

* * * * *